US007503106B2

(12) United States Patent
Crutchley et al.

(10) Patent No.: US 7,503,106 B2
(45) Date of Patent: Mar. 17, 2009

(54) METHOD OF FASTENING

(75) Inventors: Derek Crutchley, Warrington (GB); Jonathan Lee Brewer, Dunstable (GB); Keith Denham, Heirtfordshire (GB)

(73) Assignee: Textron Fastening Systems Limited (GB)

( * ) Notice: Subject to any disclaimer, the term of this patent is extended or adjusted under 35 U.S.C. 154(b) by 72 days.

(21) Appl. No.: 10/498,623

(22) PCT Filed: Dec. 13, 2002

(86) PCT No.: PCT/GB02/05661

§ 371 (c)(1),
(2), (4) Date: Jan. 24, 2005

(87) PCT Pub. No.: WO03/051557

PCT Pub. Date: Jun. 26, 2003

(65) Prior Publication Data

US 2005/0155212 A1 Jul. 21, 2005

(30) Foreign Application Priority Data

Dec. 14, 2001 (GB) ..... 0129878.5

(51) Int. Cl.
*B23P 11/00* (2006.01)

(52) U.S. Cl. ..... 29/525.11

(58) Field of Classification Search ..... 29/525.05, 29/525.06, 525.07, 525.11, 525.01, 525.12, 29/505, 523, 243.522, 243.53, 283.5; 411/43, 411/41

See application file for complete search history.

(56) References Cited

U.S. PATENT DOCUMENTS 4,488,843 A * 12/1984 Achille ..... 411/41
4,701,993 A 10/1987 Bradley et al.

FOREIGN PATENT DOCUMENTS

EP 0725221 8/1996
EP 0841491 B1 5/1998

* cited by examiner

*Primary Examiner*—John C Hong
(74) *Attorney, Agent, or Firm*—Trexler, Bushnell, Giangiorgi, Blackstone & Marr, Ltd.

(57) ABSTRACT

A method and fastener for fastening one or more apertured members (48) to an apertured workpiece (52), an aperture (50) of the or each member (48) being aligned with an aperture (54) in the workpiece (52), the method comprising the steps of inserting a fastener (10) into the aligned apertures, the fastener (10) being formed of ductile material and having a head (14), a shank (12), and an axial bore (22) extending through the shank (12) and into the head (14), the shank (14) being circumferentially entire and being formed with an external screw-thread (18) the fastener (10) being inserted so that the head (14) engages a face of the one member (48), and the shank (12) extends through the member (48) or members and into the workpiece (52), and at least a part of the screw-thread (18) is within the workpiece (52), and then, while supporting the fastener (10) at the head (14), drawing into and entirely through the bore (22), in the direction from the tail portion to the head (14), a tapering, enlarged, mandrel head (32) capable of expanding the bore (22) and thereby enlarging the bore (22) evenly throughout its length and causing ductile radial expansion of the shank (12) sufficient to case the external screw-thread (18) to embed in the workpiece (52) and the shank (12) of the fastener (10) undergoing ductile axial reduction in length.

7 Claims, 5 Drawing Sheets

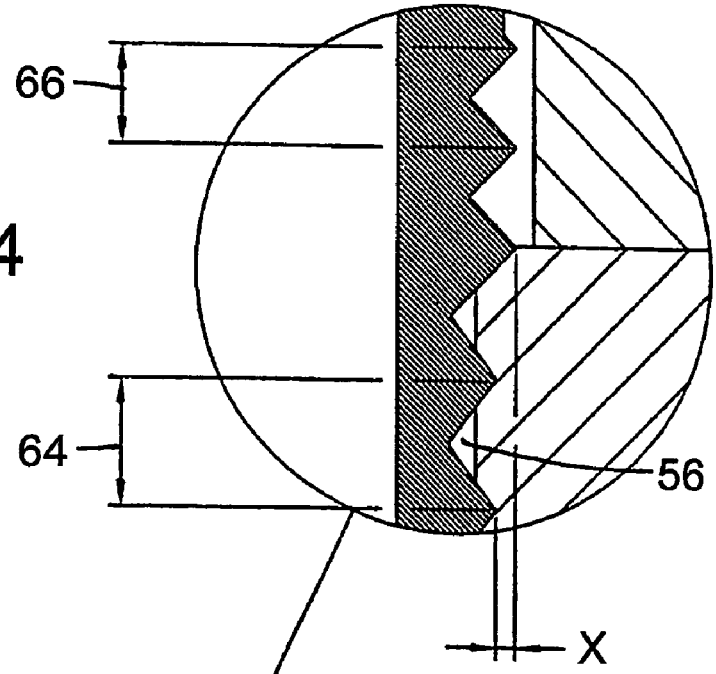
Fig.4
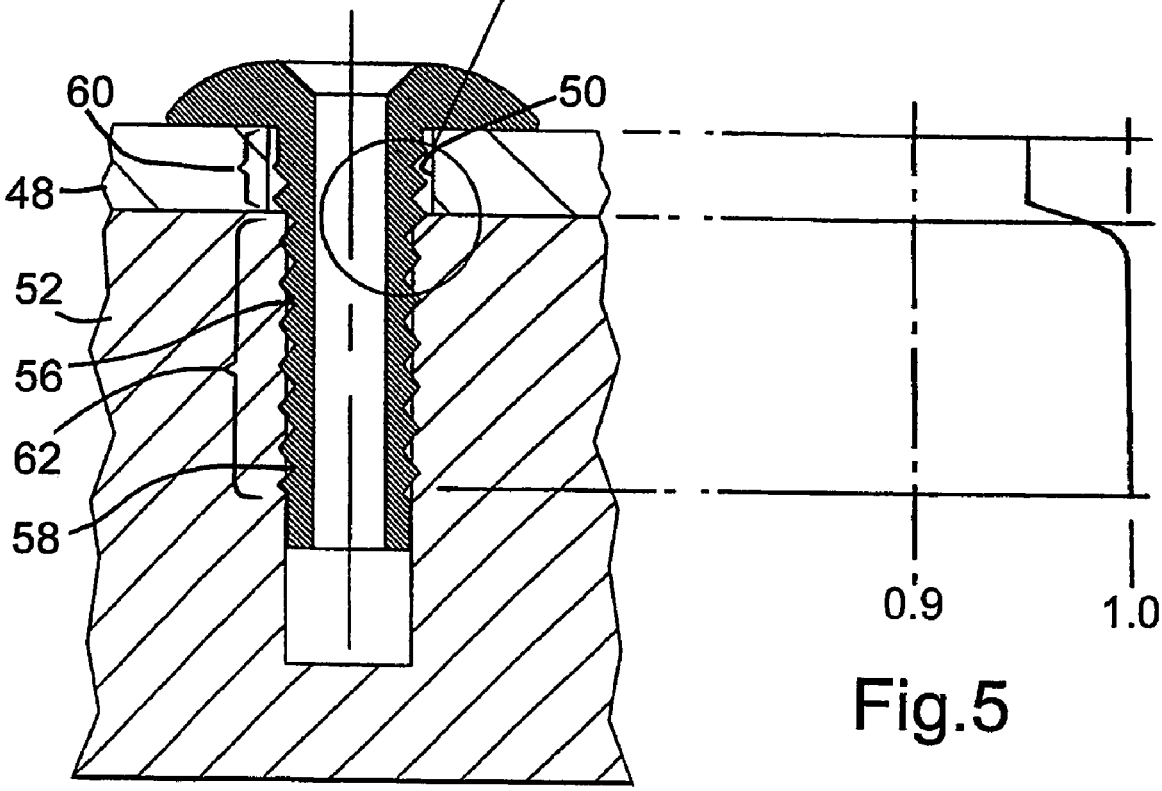
Fig.5
Fig.3

METHOD OF FASTENING

RELATED/PRIORITY APPLICATION

This application is a National Phase filing regarding International Application No. PCT/GB02/05661, which relies upon British Application No. 0129878.5 for priority.

The invention relates to a method of fastening, using fasteners such as those described in U.S. Pat. Nos. 4,642,010 and 4,701,993, to which the reader is referred for the background to the present invention.

On such prior art rivets, a clamping force in the components being joined is achieved by deforming the head of the rivet so as to move a radially outer part of the head towards the tail end of the rivet (claim 4 of U.S. Pat. No. 4,701,993). One problem with this is that in practice, to achieve the desired result, the rivet head undergoes severe deformation—the head geometry typically is 120° included angle countersunk, which is deformed to 120° conical form during installation of the rivet (compare FIGS. 3 and 4 of U.S. Pat. No. 4,701,993). This represents a complete inversion of the head form. This can have the effect of weakening or damaging the protective coating which is normally applied to the rivet e.g. zinc plating or nickel plating. Also, to some customers the resultant conical head shape is not acceptable from a cosmetic point of view.

On prior art rivets on applications where it is not necessary or desirable to provide clamping of the joint, a rivet which has a non-deforming head may be used (column 7, line 7 of U.S. Pat. No. 4,701,993).

The present invention seeks to reduce the need to provide different designs of fasteners for use in different applications, and also to provide improved resulting fastenings.

The invention provides, in one of its aspects, a method of fastening one or more apertured members to an apertured workpiece, as set out in the primary claim of the appended claims.

Further preferred features of the invention are set out in the remaining claims.

Embodiments of the invention will now be described, by way of example, with reference to the accompanying drawings, in which:

FIG. 3 is a view, in section, similar to FIG. 2, showing the completion of the installation;

FIG. 4 is an enlarged view, in section, of part of the installed fastener;

FIG. 5 is a graph showing the change of thread pitch on the installed fastener;

Figure 1:
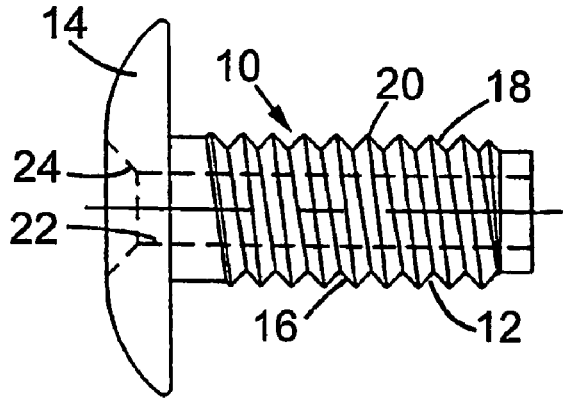
FIG. 1 is a side elevation of one form of the fastener, as manufactured and before use.

FIGS. 8 to 11 show, in part section, the progressive stages of the fastener of FIG. 1 being installed in a joint in which a non-rigid member is attached to the workpiece also showing part of one form of installation apparatus; and FIGS. 12 to 15 show, in part section, the progressive stages of the fastener of FIG. 1 including part of another form of installation apparatus, being installed in a joint in which a gap between the joint member is closed by the fastener.

Referring to FIG. 1 a fastener 10 has an elongate shank 12 of generally cylindrical shape and a radially enlarged head 14 at one end (the head end of the shank). The external surface of a part 16 of the shank is formed with a screw thread 18. The thread 18 is of V shape in cross-section, and provides a crest 20 at which its flanks meet at an angle of, in this embodiment, 90°. Between adjacent turns of the thread the flanks form a substantially V shaped trough.

The fastener has an axial bore 22 throughout the shank and head, the bore being substantially constant in diameter, but having a countersink 24 at the head end.

The fastener is made from carbon steel and is harder than, for example, aluminium, magnesium and a variety of engineering plastic materials such as might form a workpiece in which it might be desired to install the fastener.

The material of the fastener is sufficiently ductile for the shank to be deformed by radial expansion to an extent such that the major diameter of the shank (that is the diameter taken across the crest of the thread) after expansion is greater than before expansion by at least the depth of the thread.

Figure 2:
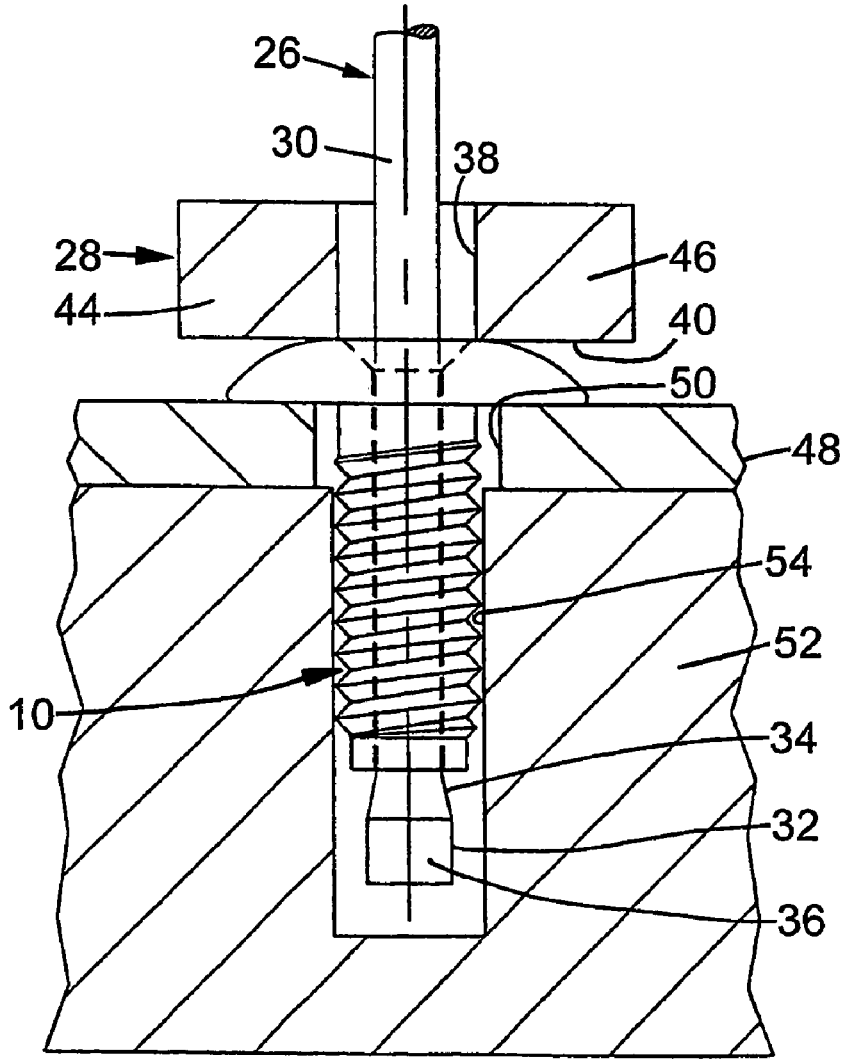
FIG. 2 is a side elevation, partly in section, illustrating an early stage in the installation of the fastener of FIG. 1 in a workpiece.

Referring to FIG. 2, the fastener 10 is installed by means of apparatus comprising a mandrel 26, an annular anvil 28 and means (not shown) for gripping and pulling the mandrel axially relative to the anvil.

The mandrel 26 has an elongate stem 30 which is able to pass with clearance through the bore of the fastener, and an enlarged head 32 at one end of the stem. The mandrel head 32 has a conical tapering portion 34 in which the diameter of the mandrel increases progressively away from the stem 30 to a diameter substantially greater than that of the bore 22 of the fastener, and leads to a somewhat elongate portion 36 of the head in which the cross-sectional shape of the mandrel is circular, as shown, or may be the shape of a regular hexagon. The mandrel is formed from high tensile steel.

The annular anvil 28 has an axial passage 38 through which the stem of the mandrel can be passed into engagement with the gripping and pulling means, and an abutment face 40 at its forward end. In the embodiments illustrated in FIGS. 2 to 11 the abutment face is flat. In the embodiment illustrated in FIGS. 12 to 15 the abutment face has a central recess 42 of generally part-spherical shape. The anvil is divided longitudinally of its axis, being formed of two semi-annular jaws 44, 46 which are identical to each other and which co-operate together to form the whole anvil. The jaws are separable diametrically of the axis of the anvil to allow a fastener, or a succession of the fasteners, to be fed forwardly through the separated jaws and along the stem of the mandrel towards the mandrel head 32, and can then be closed together behind the or each fastener in turn so as to co-operate again to provide the abutment face 40.

The apparatus may be used to install fasteners in a manner substantially the same as that used in repetition riveting.

Thus, the fastener 10 is fed on to the stem of the mandrel so that the stem extends through the bore 22 and the mandrel head 32 is adjacent the tail end of the fastener but outside the bore, and with the stem of the mandrel passing through the passage 38 of the anvil into engagement with the pulling means so that the fastener is between the mandrel head and the abutment face 40 of the anvil.

A plurality of further fasteners (not shown) may at the same time be disposed on the stem behind the anvil, ready to be fed one at a time through the jaws into position between the mandrel head and the abutment face of the anvil.

The fastener 10 thus associated with the installing apparatus is offered to the work and the mandrel head and tail portion of the fastener are entered through the aperture 50 of the member 48 and into the aperture 54 of the workpiece 52 until the anvil pushes the head of the fastener into engagement with the near face of the member 48 and, in turn, urges the member 48 into abutment with the near face of the workpiece. The installing apparatus is then actuated to pull the mandrel through the fastener, thus drawing the head of the mandrel into the tail end and through the bore while the head of the fastener is supported by the abutment face of the anvil.

It will be appreciated that the tapered portion 34 of the mandrel head leads the cylindrical portion 36 into the bore of the fastener and as it does so expands the shank progressively from the tail end towards the head. As the expansion of the shank progresses towards the head of the fastener there comes a time when the crest 20 of the external thread 16 at the leading edge of the progressively expanding parts of the shank first engages the material of the workpiece 52 and begins to embed into the material. At this point the axial position of the engaged threads become substantially fixed.

It will be appreciated that the degree of penetration of the threads into the workpiece material is a function of the expanded diameter of the fastener and the diameter ($d_1$) of the aperture 54 in the workpiece, and that the expanded diameter of the fastener, in turn, is a function of the diameter ($d_2$) of the bore 22 of the fastener, the original diameter ($d_3$) of the shank of the fastener, and the diameter ($d_4$) of the cylindrical portion 36 of the mandrel head. The dimensions $d_1$, $d_2$, $d_3$ and $d_4$ are selected to provide a degree of thread penetration into the workpiece of not more than half of the overall height of thread 18. Thus, referring to FIG. 3, a space 56 remains at the root 58 of the V shape trough of the expanded thread. If dimensions $d_1$, $d_2$, $d_3$ and $d_4$ were such that the root 58 were completely, or nearly completely, filled with workpiece material, a consequential very high radial pressure within the fastener material at the point of expansion would be required. This has two undesirable effects. Firstly, the axial pulling load on the mandrel would be correspondingly high which might cause the stem 30 of the mandrel to be overstressed. Secondly, it could cause the shank of the fastener to elongate during installation. Thus the member 48 would not be securely clamped to the workpiece 52 by the installed fastener.

The dimensions $d_1$ and $d_3$ and the angle of the conical tapering portion 34 of the mandrel head are selected such that the progressively expanding part of the shank of the fastener first engages the material of the workpiece and therefore becomes substantially axially fixed, before the axial pulling load of the mandrel reaches a magnitude sufficient to axially compress the fastener.

The aperture 50 in the member 48 is large enough to allow the fastener to expand within the aperture without any substantial radial constraint. Thus the diameter of the expanded thread portion 60 within the member is slightly larger than the diameter of the thread portion 62 within the workpiece, as shown by dimension 'X' in FIG. 4. The effect of this unconstrained expansion within the aperture 50 is to cause an axial reduction in length of the portion of the fastener shank contained within the member. It will be appreciated that even a small amount of length reduction in, for example, a fastener manufactured from steel, will result in a high value of tensile stress which in turn creates a high clamping force between the head of the fastener and the workpiece. It is necessary to select dimensions $d_1$, $d_2$, $d_3$ and $d_4$ to provide sufficient penetration of the expanded thread into the workpiece to support this clamping force, and any tensile force applied to the installed fastener in service, without causing stripping of the threads.

It has been found by experiment that a fastener of the present example and manufactured with the following dimensions will function in the intended manner when installed in a workpiece of cast magnesium with a 5.42 mm hole diameter ($d_1$) to which a steel member 4 mm thick and with a 6.3 mm diameter hole, is attached by the fastener, using a mandrel of diameter 3.5 mm ($d_4$). The dimensions of the fastener being: diameter of bore 22 is 2.76 mm ($d_2$), diameter of shank (diameter over crests of thread) is 5.3 mm ($d_3$), length of shank 16 mm, thread pitch 1.0 mm. In this case between 30% to 40% of the thread depth is expanded into the workpiece. This is more than sufficient to support any tensile loads imposed on the fastener in service. In fact the retention of the fastener in the workpiece at this level of thread penetration is sufficient to cause the fastener to rupture, rather than the threads to strip, when an excessive tensile load is applied to the installed fastener. Also, for example, if a tightening torque is applied to the installed fastener, for example, in the case where an equivalent hexagonal head mandrel is used, and a hexagonal wrench is used, then the torque which causes the threads to strip is well in excess of the recommended maximum tightening torque of the equivalent screw or bolt (in this case an M6 setscrew, grade 8.8).

Of course, it will be realised that the thread stripping torque and the pull-out tensile load will depend to an extent on the amount of fastener shank (i.e. the length) which is engaged in the workpiece, this in turn being determined by the thickness of the member or members being attached to the workpiece. It has been found that the installed fastener strength characteristics described above are maintained when at least half the length of the shank is engaged in the workpiece, that is in this example 8 mm.

When the member 48 is very thin, that is less than 1.5 mm in the example above, then in order to obtain the clamping effect which is produced when the threaded position adjacent the head of the fastener expands without radial constraint, it may be necessary to produce a counterbore in the aperture 54 of the workpiece. For a fastener of the same construction as the example quoted, and a member with a thickness, for example, of 1 mm, then a counterbore depth of 2 mm would be sufficient Referring to FIG. 4, the thread pitch 64 of that portion of the fastener contained within the workpiece remains substantially unaltered, that is 1.0 mm in the example quoted. However, the thread pitch 66 of that portion of the fastener contained within the member 48 has reduced, in the example quoted to 0.94 mm. This effect is illustrated by the graph shown in FIG. 5.

Figure 6:
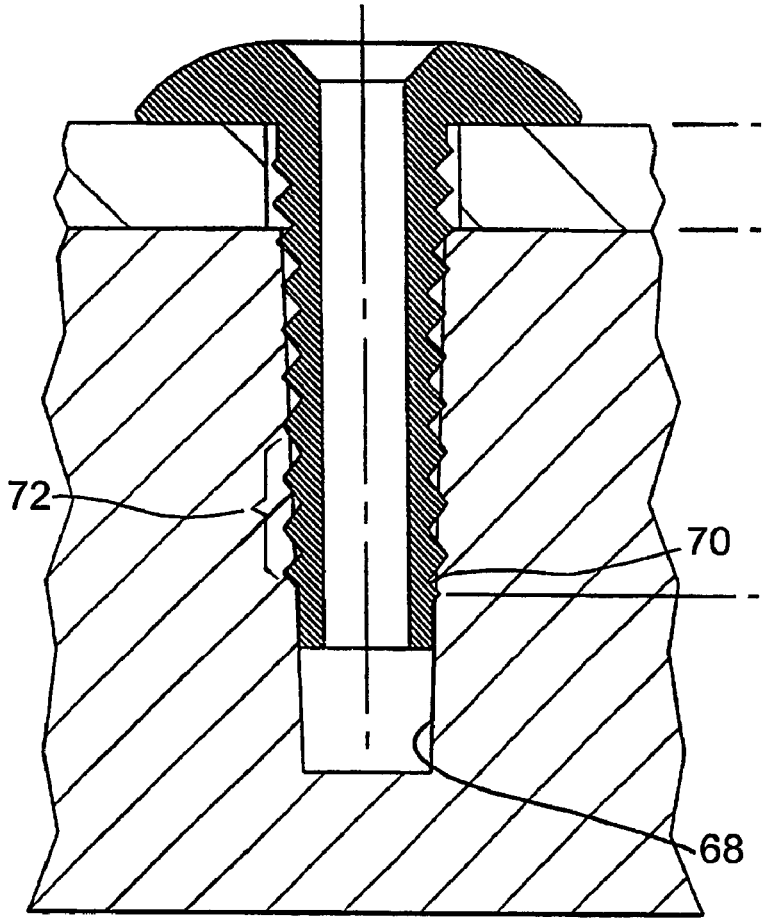
FIG. 6 is a view, in section, of the fastener of FIG. 1 installed in a workpiece having a tapered hole.
Figure 7:
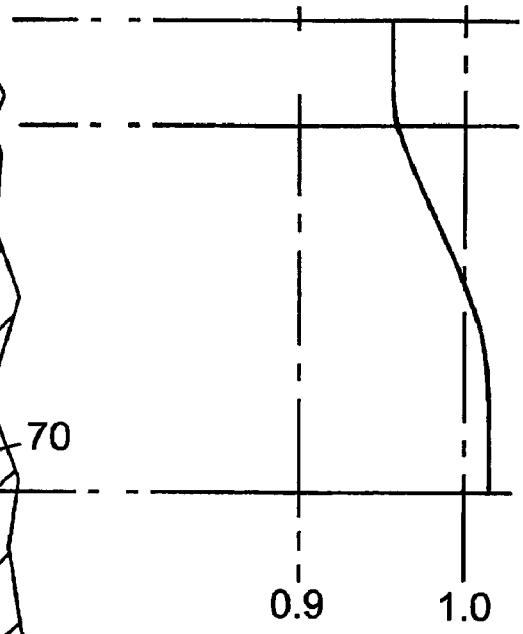
FIG. 7 is a graph showing the variation in thread pitch of the fastener illustrated in FIG. 6.

In some applications it will be preferable to use the fastener in workpieces in which the aperture, for receiving the fasteners are produced by a casting operation. In which case, the apertures will preferably have a taper (or draft), the angle of the draft being typically 1° to 1.5° inclusive. The fastener of the present invention will function satisfactorily in such a tapered hole. Referring to FIG. 6 and the corresponding graph of thread pitch in FIG. 7, the aperture 68 in the workpiece is shown with an exaggerated taper for the purpose of illustration. The dimensions of the fastener and aperture are selected such that in the case of a minimum thickness member, the fastener can be inserted fully into the hole without interference, otherwise there could be a gap between the member and the top face of the workpiece and/or between the member top face and the head of the fastener.

FIG. 6 shows the installed fastener for the extreme case in which, when the fastener prior to installation is inserted through the aperture in the member and into aperture 68 in the workpiece, the remote end of the shank just contacts the tapered wall of the aperture 68, with no gaps between the member and the workpiece or between the member and the head of the fastener. In this case there may be a depth of penetration of the expanded threads, on portion 72 of the shank, greater than 50% of the thread depth, and because this will result in excessive radial constraint of the fastener as it expands in this region there can be elongations of the shank in this region. On the example fastener installed in a workpiece aperture having a 1° taper, the thread pitch on the expanded fastener, in portion 72, can be 1.03 mm. However as the aperture progressively enlarges towards the top face of the workpiece, the radial constraint correspondingly reduces, the depth of thread penetration may reduce to less than half of the thread depth. The overall effect is for the installed fastener to reduce in length and therefore to provide the required clamping force onto the member.

Figures 8, 9, 10, 11:
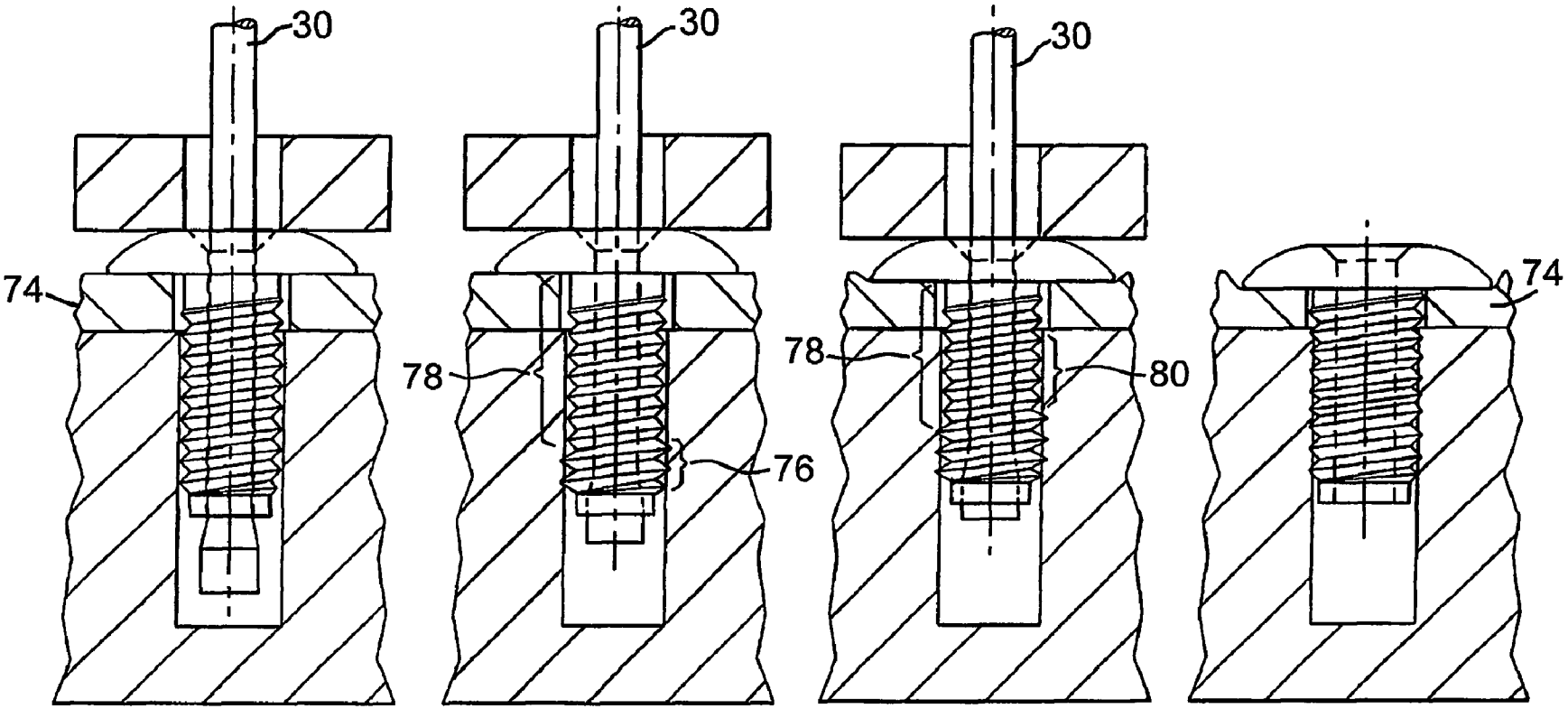

In applications where the member to be attached to the workpiece is manufactured from a non-rigid material, such as an elastomeric material, the reduction in length of the fastener which occurs during the installation process has the effect of compressing the member as shown in FIGS. 8 to 11. As in the previous case, a fastener is entered through the aperture in the member and into the aperture in the workpiece in the same manner as previously described. In this case the member 74 (FIG. 8) is an elastomeric material. As the mandrel head is drawn through the rivet bore by the installing apparatus and the leading edge of the progressively expanding part of the shank first engages the material of the workpiece, as shown in FIG. 9, and begins to embed into the workpiece material, the engaged threads 76 (FIG. 9) become substantially fixed, as described before. As the axial pulling force exerted on the mandrel stem by the installing apparatus increases, so does the compressive force in the fastener shank portion 78 between the fastener head and the engaged threads 76. As the force further increases, shank portion 78 (FIG. 10) compresses plastically, until the remaining threads 80 (FIG. 10) are constrained from expansion by their contact with the aperture in the workpiece, and the resistance to deformation of the elastomeric member. As the force further increases, the mandrel head is pulled completely through the bore of the fastener and the effect of this is to cause further foreshortening of the fastener shank in the same manner as described previously. This causes an increase in the clamp load on the member 74 (FIG. 11), and consequential further compression of the member.

It has been found in practice that in some applications there can exist a gap between the member and the workpiece which cannot be closed by the normal pushing action on an operator engaging the fastener into the member and the workpiece. When the gap is small, the foreshortening effect of the rivet shank, on a rivet according to this invention, may be sufficient to close the gap and to create a clamp force in the member. In those applications where a larger gap between the member and the workpiece might exist, a rivet as described above can be used in accordance with the present invention in conjunction with an anvil 82 (FIG. 12) which has a recess 42 in the face of the anvil which abuts the head of the fastener. The geometry and depth of the recess 42 are configured such that firstly the appearance of the finally deformed shape of the fastener head 84 (FIG. 15), is acceptable from a cosmetic point of view; and secondly that the degree of deformation of the head resulting from the installation of the fastener is not so great as to damage the protective coating on the head; and thirdly that the axial movement of the periphery of the fastener head, relative to the shank, is sufficient to cause the member to move towards the workpiece and close the prescribed gap. This embodiment of the invention will now be described in detail with reference to FIGS. 12 to 15.

Figures 12, 13, 14, 15:
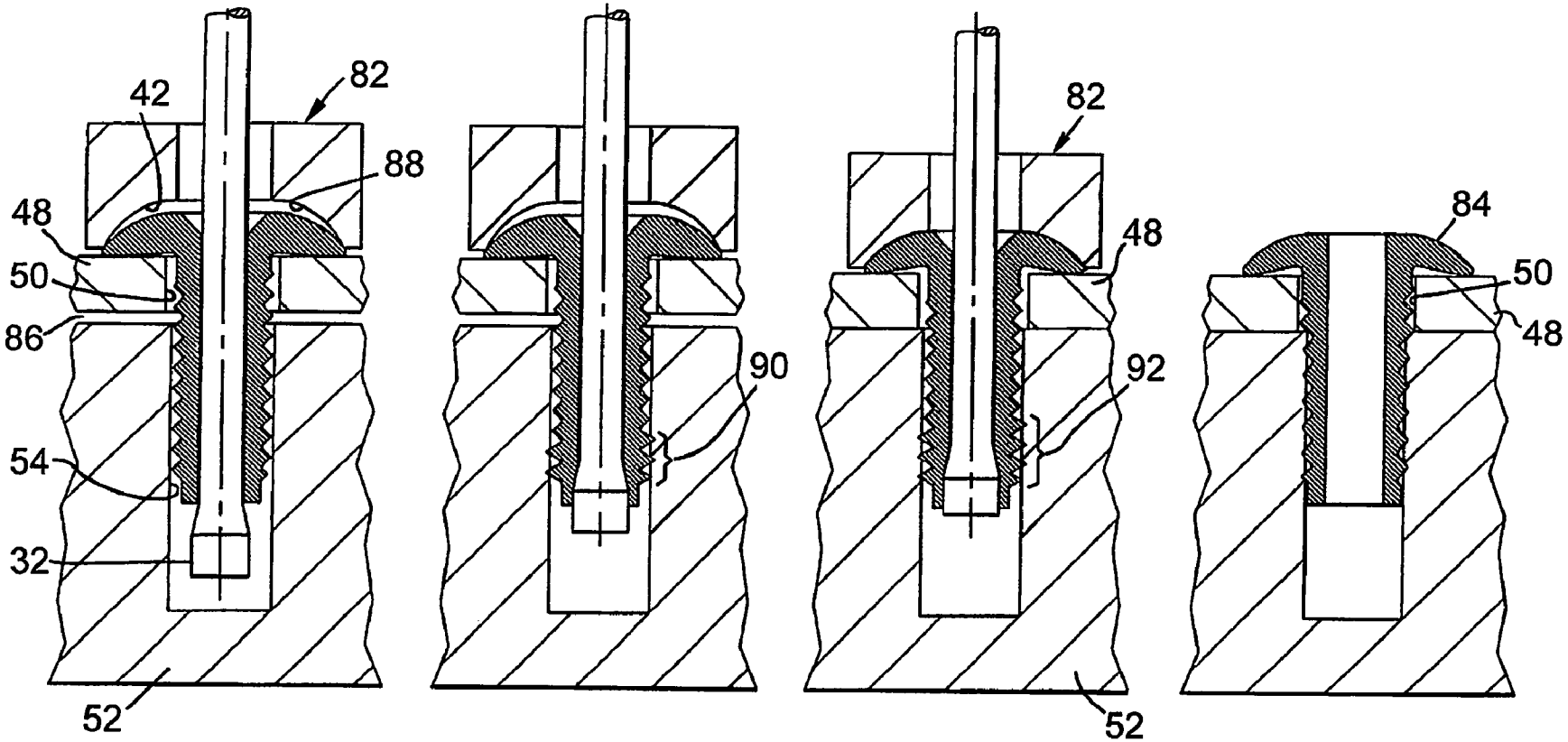

Referring to FIG. 12, as in the previous case, the fastener is entered through the aperture 50 of the member 48 and into the aperture 54 of the workpiece 52 until the anvil pushes the head of the fastener into engagement with the near face of the member 48. In this case there is a gap 86 between the member and the workpiece. The installing apparatus is then actuated to pull the mandrel through the fastener, thus drawing the head 32 of the mandrel through the bore while the head of the fastener is supported by the abutment face 88 of the anvil. During the initial phase of the installation process, as shown by FIGS. 12 and 13, the abutment face 88 of the anvil is in contact with the fastener head near to its periphery. This remains so until the mandrel head has expanded the thread portion 90 (FIG. 13), at the end of the shank, into engagement with the workpiece, thus fixing axially the end of the shank to the workpiece. As further pulling load is applied to the mandrel a greater portion 92 (FIG. 14) of the thread is expanded into engagement with the workpiece and the reactive force between the anvil 82 and the head of the fastener becomes sufficient to deform the head such that the periphery of the head is deformed towards the workpiece thus causing the member 48 to move towards and into contact with the workpiece 52, thus eliminating any gap that might have existed between the member and the workpiece. The load at which the fastener head deforms is controlled, for any given fastener material and metallurgical condition, by careful selection of the geometry of the fastener head and the anvil recess, such that the head will deform to the required extent at a mandrel pulling load which is greater than that which is necessary to produce the engaged thread portion 90 (FIG. 13), and less than the maximum pulling load required to pull the mandrel head completely through the bore of the fastener. As in the previous case, the portion of expanded fastener shank contained within the aperture 50 (FIG. 15) in member 48 does not have the radial constraint of that portion of the shank which is expanded into the workpiece. As in the previous case, the effect of this unconstrained expansion in aperture 50 is to cause an axial reduction in length of the portion of the fastener contained within the member, resulting in a clamping force between the head of the fastener and the workpiece. It will be appreciated that on many applications where a member is required to be fastened to a workpiece, several fasteners at different locations will be used. As some of these locations there may be gaps between the member and the workpiece, such as is shown at 86 (FIG. 12), whilst at other locations there will be no gaps, depending on the particular member and workpiece. On such applications it is obviously desirable to use identical fasteners and the same type of installing equipment at each location irrespective of whether or not there is a gap. A fastener and installing equipment of the present embodiment will function satisfactorily when there is no gap between the member and the workpiece. In this case, when the first few threads of the fastener shank have engaged in the workpiece, corresponding to FIG. 13, and therefore fixing axially the end of the shank to the workpiece, as further pulling load is applied to the mandrel, the reactive load of the anvil on the fastener head is urging it to deform. However, if there is no gap between the member and the workpiece, and if the member is manufactured from relatively hard material, for example aluminium, or carbon fibre composite, or steel, then the periphery of the fastener head is prevented from deforming towards the workpiece and the profile of the head will be substantially unchanged between the pre-installed and the installed fastener. It will be appreciated that if the member 48 is manufactured from a plastic material, for example nylon, or polyurethane, then the periphery of the head will deform to a degree under the influence of the reactive force on the anvil and the force resisting deformation of the member. In this case the fastener head will not deform to the extent shown in FIG. 15, but will deform to some degree intermediate between that shown in FIG. 12 and that in FIG. 15. If the member 48 is manufactured from very soft material, for example rubber or plastic foam, then it will have a low resistance to deformation and the installed fastener will have head profile as shown in FIGS. 14 and 15, i.e. one that is determined fully by the geometry of the recess 42 (FIG. 12) of the anvil.

The embodiments described above show the example fasteners installed in blind holes in the workpiece which extend beyond the end of the fastener shank. This is not essential as the fastener will function in accordance with this invention even if the hole in the workpiece is non blind, and even if part of the threaded shank of the fastener projects beyond the end face of the workpiece, remote from the head of the fastener.

In the examples the mandrel head is illustrated as being of circular cross-section. It will be appreciated that a mandrel having a head cross-sectional shape which is polygonal, to provide a plurality of wrenching surfaces, and which provides an equivalent amount of ductile radial expansion of the shank, may be used.

It will be seen that the foregoing examples include the provision of a method of fastening which produces a high clamping force in the joined members without the need to severely deform the head of the rivet and such that the rivet head geometry of the initialled rivet is substantially unaltered from its original manufactured form.

Also provided is a method of fastening in which the shank is radially expanded and at the same time is axially reduced in length to provide compression, for example, of a non-rigid member being joined to the workpiece by the rivet.

Also provided is a method of fastening in which the rivet and its installation tool are configured such that during installation of the rivet, the head of the rivet is deformed towards the tail end of the rivet which is effective in closing any gaps which may be present between the member being joined and the workpiece.

It will be seen that the workpiece in which a fastener is to be installed should be of a material which is less hard than the material of the rivet. The rivet is intended for use in soft metals, such as aluminium and magnesium and in plastics.

The workpiece should have an aperture into which the shank of the rivet can be inserted, preferably with a minimum of clearance peripherally of the shank. The aperture should be a blind hole which may be of uniform diameter or with a shallow taper typical of holes produced by casting in aluminium or magnesium castings.

The member which is being attached to the workpiece by the rivet should have an aperture which is larger in diameter than the expanded diameter of the rivet.

The invention is not restricted to the details of the foregoing examples. For example, the bore of the fastener used need not be uniform in dimension along its length.

The invention claimed is:

1. A method of fastening one or more apertured members to an apertured workpiece, an aperture of the or each member being aligned with an aperture in the workpiece, which method comprises the steps of inserting into the aligned apertures a fastener, said fastener being formed of ductile material and having a head, a shank, and an axial bore extending through the shank and into the head, said shank being circumferentially entire and being formed with an external screw-thread, said fastener being inserted so that the head engages a face of the said one member, and the shank extends though the member or members and into the workpiece, and at least a part of the screw-thread being within the workpiece, and then, while supporting the fastener at the head, drawing into and entirely through the bore, in the direction from the tail portion to the head, a tapering, enlarged, mandrel head capable of axially compressing the shank of the fastener between the mandrel head and the support at the fastener head, and of expanding the bore, and thereby enlarging the bore evenly throughout its length and causing ductile radial expansion of the shank sufficient to cause the external screw-thread to embed in the workpiece and the shank of the fastener undergoing ductile axial reduction in length, whereby the diameter of the bore of the fastener, the original diameter of the shank of the fastener, the diameter of the cylindrical portion of the mandrel head, and thereby the expanded diameter of the fastener are such that the depth of penetration is less than half of the thread depth.

2. A method according to claim 1, wherein plastic axial reduction in length takes place after some portion of the external screw thread on the shank of the fastener has embedded in the workpiece.

3. A method according to claim 1, wherein axial compression of the shank takes place after some portion of the external screw thread on the shank of the fastener has embedded in the workpiece.

4. A method according to claim 1, including, if appropriate, deforming the head of the fastener, after the screw-threaded part has engaged the workpiece, so as to move a radially outer part or parts of the head of the fastener in a direction towards the tail portion of the shank, thereby to close any gap between a member and another member of the workpiece and/or, if one of the foregoing is deformable, to deform it, thereby clamping the said other member or members tightly between the head of the fastener and the workpiece.

5. A method according to claim 1, including, while expanding the fastener, changing the cross-sectional shape of the bore from its original shape to a polygonal keying shape which provides a plurality of wrenching surfaces such as to permit keying engagement and rotation of the fastener by means of a suitable wrenching tool after expansion.

6. A method according to claim 5 wherein said polygonal keying shape is that of a regular hexagon.

7. A method as claimed in claim 1, in which the radial expansion of the shank of the fastener is such as to provide a degree of penetration of the shank's screw thread into the workpiece of not more than half of the overall height of the screw thread.

* * * * *